US006106251A

United States Patent [19]

Monnier et al.

[11] Patent Number: 6,106,251

[45] **Date of Patent: *Aug. 22, 2000**

[54] SCROLL MACHINE WITH REVERSE ROTATION SOUND ATTENUATION

[75] Inventors: Kenneth Joseph Monnier; Frank Shue Wallis; Randall Joseph Velikan, all of Sidney, Ohio

[73] Assignee: Copeland Corporation, Sidney, Ohio

[ * ] Notice: This patent is subject to a terminal disclaimer.

[21] Appl. No.: 09/106,388

[22] Filed: Jun. 26, 1998

Related U.S. Application Data

[63] Continuation-in-part of application No. 08/742,918, Nov. 1, 1996, Pat. No. 5,772,415.

[51] Int. Cl.[7] ..... F04C 29/00

[52] U.S. Cl. ..... 418/14; 418/55.1; 418/55.5; 418/57

[58] Field of Search ..... 418/14, 55.1, 55.5, 418/57

[56] References Cited

U.S. PATENT DOCUMENTS

| | | | |
|---|---|---|---|
| 4,415,318 | 11/1983 | Butterworth et al. . | |
| 4,522,574 | 6/1985 | Arai et al. . | |
| 4,674,963 | 6/1987 | Morishita et al. | 418/55.1 |
| 4,867,282 | 9/1989 | Hartley . | |
| 4,877,382 | 10/1989 | Caillat et al. . | |
| 4,954,057 | 9/1990 | Caillat et al. | 418/55.6 |
| 5,102,316 | 4/1992 | Caillat et al. . | |
| 5,108,274 | 4/1992 | Kakuda et al. . | |
| 5,129,798 | 7/1992 | Crum et al. . | |
| 5,156,539 | 10/1992 | Anderson et al. . | |
| 5,174,739 | 12/1992 | Kim | 418/55.5 |
| 5,346,376 | 9/1994 | Bookbinder et al. . | |
| 5,433,589 | 7/1995 | Wada et al. . | |
| 5,496,157 | 3/1996 | Shoulders et al. . | |
| 5,545,019 | 8/1996 | Beck et al. . | |
| 5,551,851 | 9/1996 | Williams et al. | 418/55.1 |
| 5,580,229 | 12/1996 | Beck et al. . | |
| 5,772,415 | 6/1998 | Monnier et al. | 418/14 |
| 5,984,653 | 11/1999 | Misiak | 418/55.1 |

*Primary Examiner*—Thomas Denion
*Assistant Examiner*—Thai-Ba Trieu
*Attorney, Agent, or Firm*—Harness, Dickey & Pierce, P.L.C.

[57] ABSTRACT

A scroll compressor has a wedge camming device operable between the orbiting scroll of the scroll compressor and a fixed wall forming part of the compressor, for the purposes of automatically engaging the wall and the orbiting scroll upon reverse operation of the compressor to thereby separate the wraps of orbiting and non-orbiting scroll during such reverse operation. Damage to the compressor in the event of powered reverse is also prevented.

24 Claims, 9 Drawing Sheets

SCROLL MACHINE WITH REVERSE ROTATION SOUND ATTENUATION

This application is a continuation-in-part of application Ser. No. 08/742,918 filed Nov. 1, 1996, U.S. Pat. No. 5,772,415.

FIELD OF THE INVENTION

The present invention relates generally to scroll machines. More particularly, the present invention relates to a device which eliminates the noise typically produced during the reverse rotation of scroll compressors such as those used to compress refrigerant in refrigeration, air conditioning and heat pump systems, as well as compressors used in air compressing systems.

BACKGROUND AND SUMMARY OF THE INVENTION

Scroll machines are becoming more and more popular for use as compressors in both refrigeration as well as air conditioning and heat pump applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port toward a center discharge port. An electric motor is provided which operates to drive the orbiting scroll member via a suitable drive shaft.

Because scroll compressors depend upon a seal created between opposed flank surfaces of the wraps to define successive chambers for compression, suction and discharge valves are generally not required. However, when such compressors are shut down, either intentionally as a result of the demand being satisfied, or unintentionally as a result of power interruption, there is a strong tendency for the pressurized chambers and/or backflow of compressed gas from the discharge chamber to effect a reverse orbital movement of the orbiting scroll member and its associated drive shaft. This reverse movement often generates objectionable noise or rumble and can possibly damage the compressor.

A primary object of the present invention resides in the provision of a very simple and unique unloader wedge cam which can be easily assembled into a conventional gas compressor of the scroll type without significant modification of the overall compressor design, and which functions at compressor shut-down to unload the orbiting scroll so that the discharge gas pressure can balance with the suction gas pressure. The present invention allows discharge gas pressure to drive the compressor in the reverse direction while the wedge cam separates the spiral wraps of the orbiting and non-orbiting scroll members thus eliminating the normal shut-down noise associated with the reverse rotation.

A further object of the present invention concerns the provision of an unloader wedge cam which can accommodate without damage extended powered reversal of the compressor, which can occur when a miswired three-phase motor is the power source.

The primary embodiment of the present invention achieves the desired results utilizing a very simple device which is rotationally driven by the compressor running gear and which under the proper conditions wedges between a fixed wall of the bearing housing and the hub of the orbiting scroll to physically prevent the flank surface of the spiral wraps from contacting during reverse rotation. The device is a wedge cam which is journaled on the upper end of the crankshaft.

These and other features of the present invention will become apparent from the following description and the appended claims, taken in conjunction with the accompanying drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figures 1, 2:
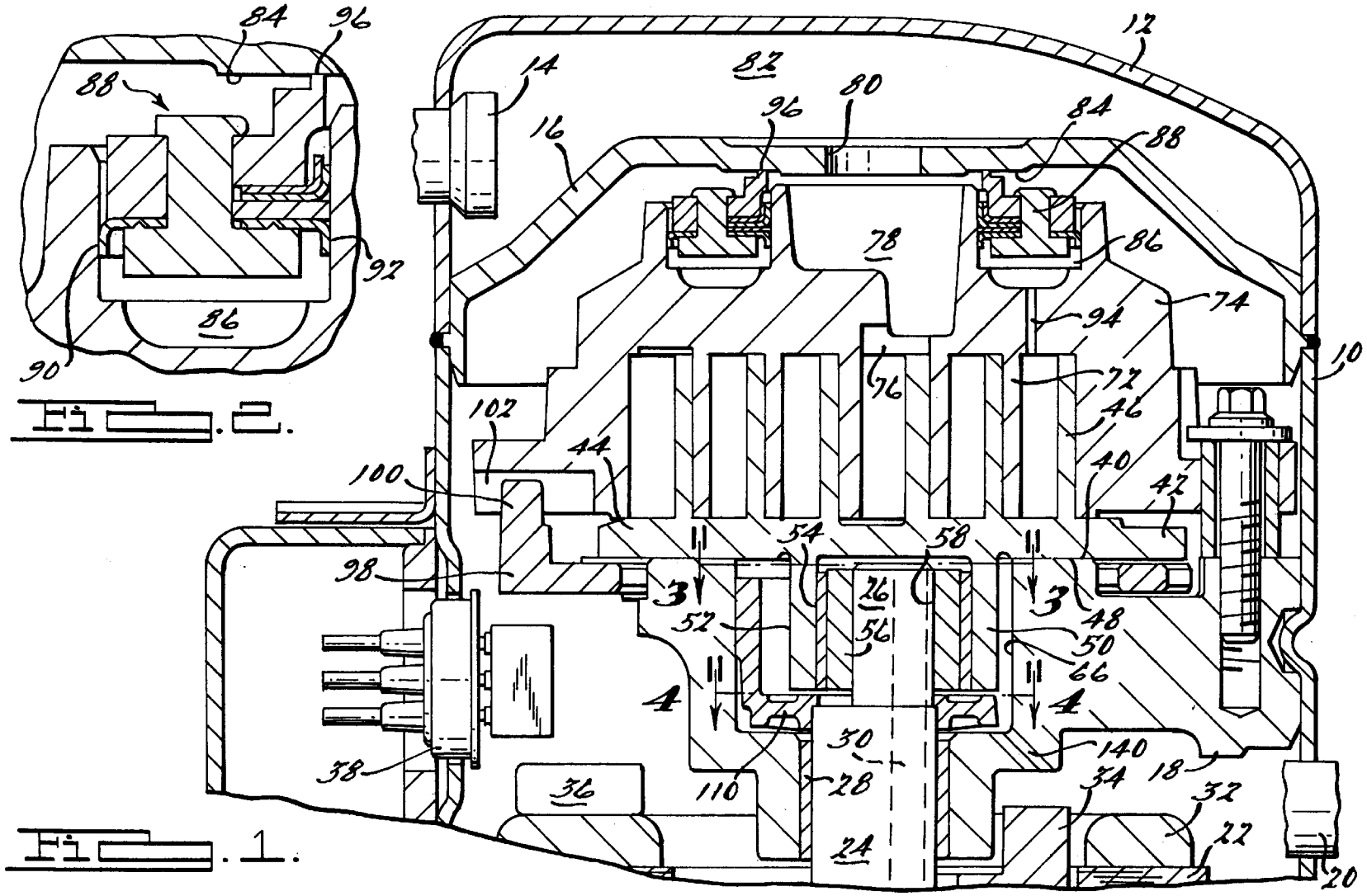
FIG. 1 is a partial vertical sectional view through the upper portion of a scroll compressor which incorporates a wedge cam in accordance with the present invention.
FIG. 2 is a fragmentary enlarged view of a portion of the floating seal illustrated in FIG. 1.

While the present invention is suitable for incorporation in many different types of scroll machines, for exemplary purposes it will be described herein incorporated in a scroll refrigerant compressor of the general structure partially illustrated in FIG. 1. Broadly speaking, the compressor comprises a generally cylindrical hermetic shell 10 having welded at the upper end thereof a cap 12, which is provided with a refrigerant discharge fitting 14 optionally having the usual discharge valve therein, and having a closed bottom (not shown). Other elements affixed to the shell include a generally transversely extending partition 16 which is welded about its periphery at the same point that cap 12 is welded to shell 10, a main bearing housing 18 which is affixed to shell 10 in any desirable manner, and a suction gas inlet fitting 20 in communication with the inside of the shell.

A motor stator 22 is affixed to shell 10 in any suitable manner. A crankshaft 24 having an eccentric crank pin 26 at the upper end thereof is rotatably journaled adjacent its upper end in a bearing 28 in bearing housing 18 and at its lower end in a second bearing disposed near the bottom of shell 10 (not shown). The lower end of crankshaft 24 has the usual relatively large diameter oil-pumping bore (not shown) which communicates with a radially outwardly inclined smaller diameter bore 30 extending upwardly therefrom to the top of crankshaft 24. The lower portion of the interior shell 10 is filled with lubricating oil in the usual manner and the pumping bore at the bottom of the crankshaft is the primary pump acting in conjunction with bore 30, which acts as a secondary pump, to pump lubricating fluid to all of the various components of the compressor which require lubrication.

Crankshaft 24 is rotatively driven by an electric motor including stator 22, windings 32 passing therethrough, and a rotor (not shown) press fit on crankshaft 24. A counterweight 34 is also affixed to the shaft. A motor protector 36 of the usual type may be provided in close proximity to motor windings 32 so that if the motor exceeds its normal temperature range protector 36 will de-energize the motor. Although the wiring is omitted in the drawings for purposes of clarity, a terminal block 38 is mounted in the wall of shell 10 to provide power for the motor.

Figure 3:
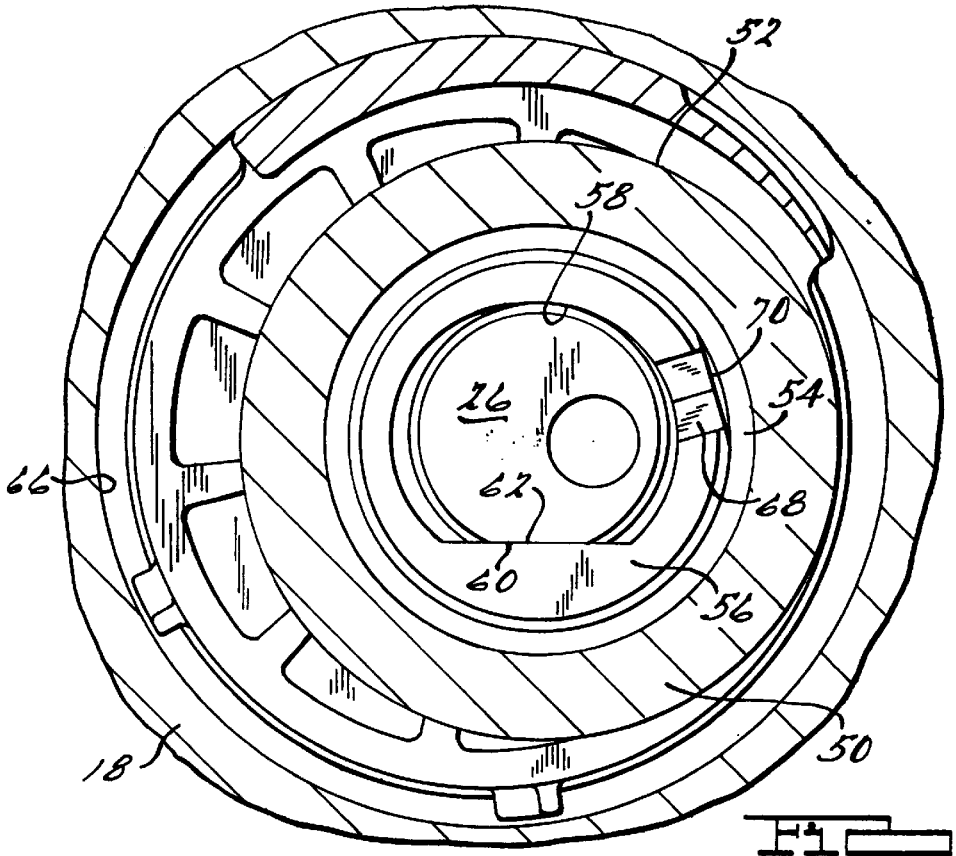
FIG. 3 is a sectional view taken along line 3—3 of FIG. 1.
Figure 4:
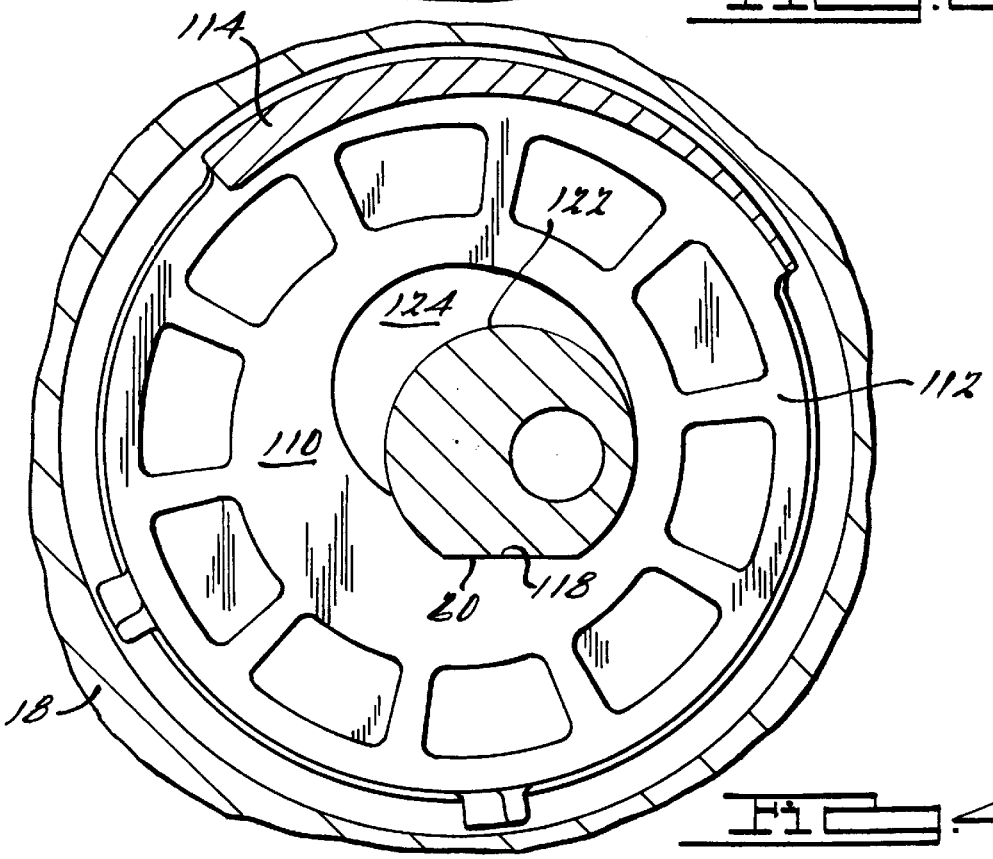
FIG. 4 is a sectional view taken along line 4—4 in FIG. 1.
Figure 5:
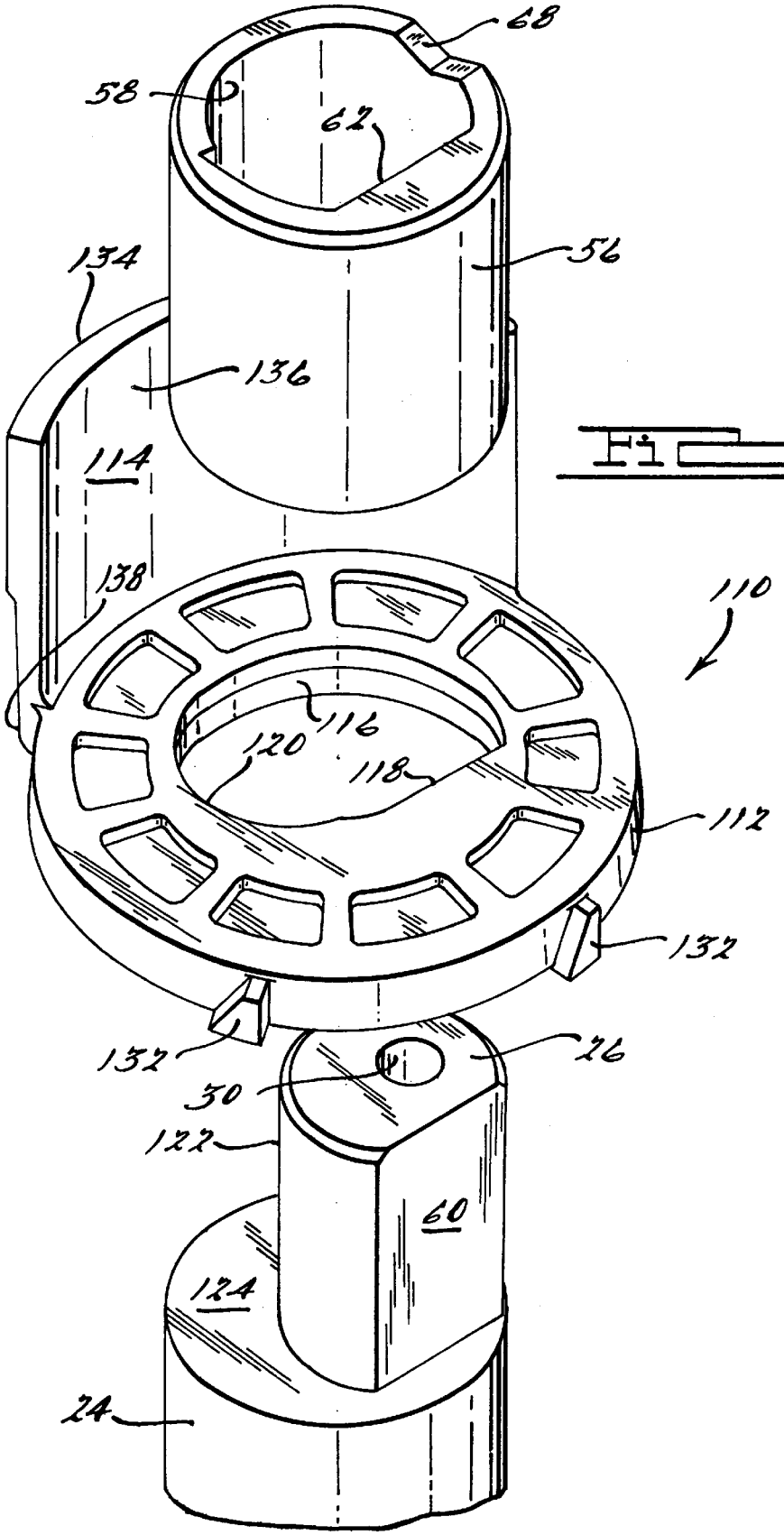
FIG. 5 is a perspective view showing the crankshaft and pin, wedge cam and drive bushing of the present invention.
Figure 6:
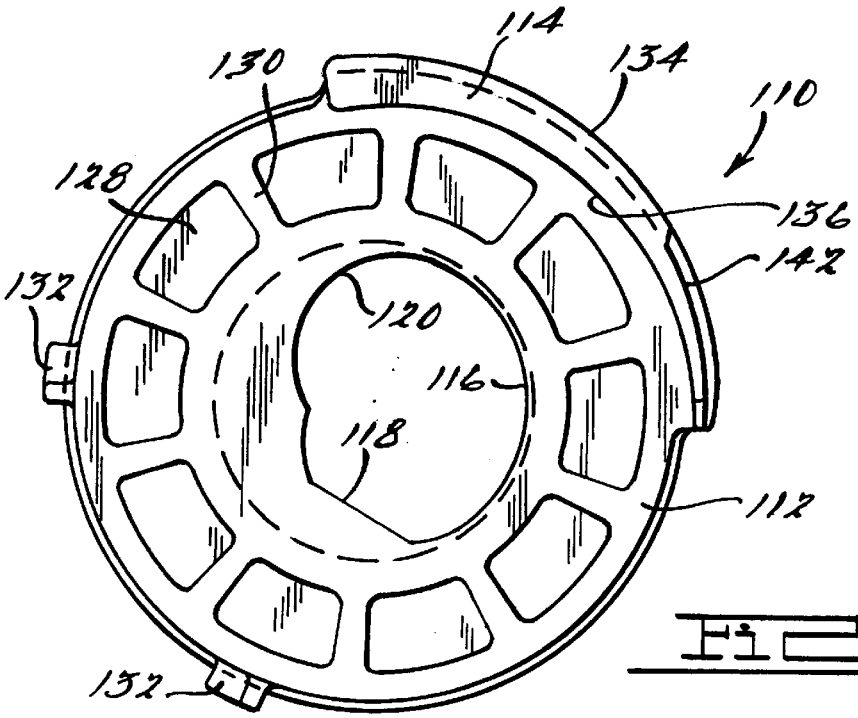
FIG. 6 is a top elevational view of a wedge cam embodying the principles of the present invention.
Figure 7:
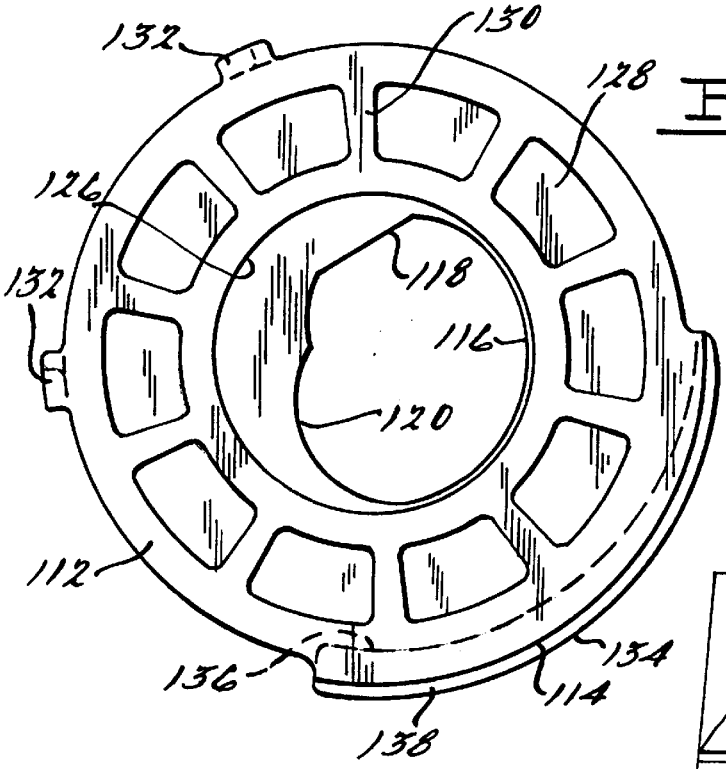
FIG. 7 is a bottom elevational view of the wedge cam of FIG. 6.
Figure 8:
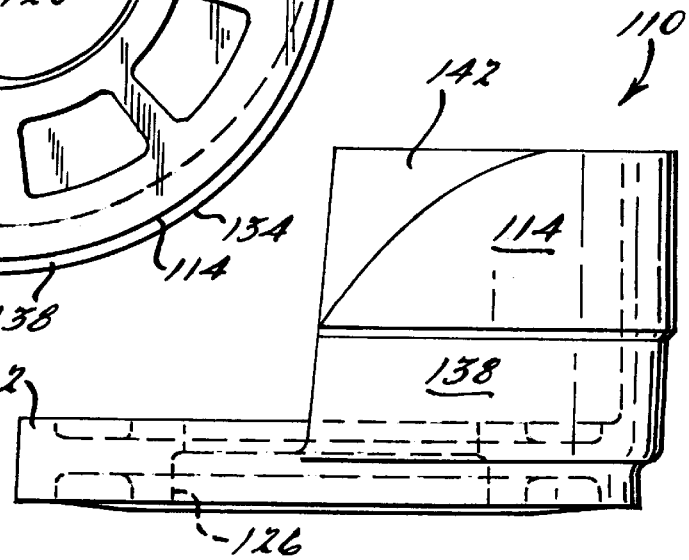
FIG. 8 is a side view of the wedge cam of FIG. 6.

The upper surface of main bearing housing 18 is provided with an annular flat thrust bearing surface 40 on which is disposed an orbiting scroll member 42 comprising an end plate 44 having the usual spiral vane or wrap 46 on the upper surface thereof, an annular flat thrust surface 48 on the lower surface thereof engaging surface 40, and projecting downwardly therefrom a cylindrical hub 50 having an outer cylindrical surface 52 and an inner journal bearing 54 in which is rotatively disposed a drive bushing 56 having an inner bore 58 in which crank pin 26 is drivingly disposed. Crank pin 26 has a flat surface 60 which drivingly engages a flat surface 62 in bore 58 (FIGS. 3 and 5) to provide a radially compliant driving arrangement for causing orbiting scroll member 42 to move in an orbital path, such as shown in applicants' assignee's U.S. Pat. No. 4,877,382, the disclosure of which is hereby incorporated herein by reference. Hub 50 has outer circular cylindrical surface 52 and is disposed within a recess in bearing housing 18 defined by a circular wall 66 which is concentric with the axis of rotation of crankshaft 24.

Lubricating oil is supplied to bore 58 of bushing 56 from the upper end of bore 30 in crankshaft 24. Oil thrown from bore 30 is also collected in a notch 68 on the upper edge of bushing 56 from which it can flow downwardly through a connecting passage created by a flat 70 on the outer surface of bushing 56 for the purpose of lubricating bearing 54. Additional information on the lubrication system is found in the aforesaid U.S. Pat. No. 4,877,382.

Wrap 46 meshes with a non-orbiting spiral wrap 72 forming a part of non-orbiting scroll member 74 which is mounted to main bearing housing 18 in any desired manner which will provide limited axial (and no rotational) movement of scroll member 74. The specific manner of such mounting is not critical to the present invention, however, in the present embodiment, for exemplary purposes, non-orbiting scroll member 74 is mounted in the manner described in detail in applicants' assignee's U.S. Pat. No. 5,102,316, the disclosure of which is hereby incorporated herein by reference.

Non-orbiting scroll member 74 has a centrally disposed discharge passageway 76 communicating with an upwardly open recess 78 which is in fluid communication via an opening 80 in partition 16 with the discharge muffler chamber 82 defined by cap 12 and partition 16. The entrance to opening 80 has an annular seat portion 84 therearound. Non-orbiting scroll member 74 has in the upper surface thereof an annular recess 86 having parallel coaxial side walls in which is sealingly disposed for relative axial movement an annular floating seal 88 which serves to isolate the bottom of recess 86 from the presence of gas under suction pressure at 90 and discharge pressure at 92 so that it can be placed in fluid communication with a source of intermediate fluid pressure by means of a passageway 94 (FIG. 1). Non-orbiting scroll member 74 is thus axially biased against orbiting scroll member 42 to enhance wrap tip sealing by the forces created by discharge pressure acting on the central portion of non-orbiting scroll member 74 and those created by intermediate fluid pressure acting on the bottom of recess 86. Discharge gas in recess 78 and opening 80 is also sealed from gas at suction pressure in the shell by means of seal 88 at 96 acting against seat 84 (FIGS. 1 and 2). This axial pressure biasing and the functioning of floating seal 88 are disclosed in greater detail in applicants' assignee's U.S. Pat. No. 5,156,539, the disclosure of which is hereby incorporated herein by reference.

Relative rotation of the scroll members is prevented by an Oldham coupling comprising a ring 98 having a first pair of keys 100 (one of which is shown) slidably disposed in diametrically opposed slots 102 (one of which is shown) in non-orbiting scroll member 74 and a second pair of keys (not shown) slidably disposed in diametrically opposed slots (not shown) in orbiting scroll member 42 displaced 90° from slots 102, as described in detail in Applicants' Assignee's U.S. Pat. No. 5,320,506 the disclosure of which is hereby incorporated herein by reference.

The compressor is preferably of the "low side" type in which suction gas entering via fitting 20 is allowed, in part, to escape into the shell and assist in cooling the motor. So long as there is an adequate flow of returning suction gas the motor will remain within desired temperature limits. When this flow ceases, however, the loss of cooling will cause motor protector 36 to trip and shut the machine down.

The scroll compressor as thus far broadly described is either now known in the art or is the subject matter of other pending applications for patent or patents of applicants' assignee.

As noted, the present invention utilizes a very simple wedge cam device which is rotationally driven by the crankshaft and which under the proper conditions functionally engages wall 66 of bearing housing 18 and outer surface 52 of hub 50 of orbiting scroll member 42 to physically prevent contact between wrap 46 and wrap 72 during reverse orbital movement of orbiting scroll member 42. It is believed that the present invention is fully applicable to any type of scroll compressor utilizing an orbiting and a non-orbiting scroll wraps, without regard to whether there is any pressure biasing to enhance tip sealing.

The present invention is illustrated in FIGS. 1 through 11 and the wedge cam, indicated at 110, is best seen in FIGS. 5 through 8. Wedge cam 110 comprises an annular base 112 having a curved wedge shaped wall 114 extending generally perpendicular to base 112.

Annular base 112 of wedge cam 110 is provided with an irregular shaped opening 116 which defines a flat driven section 118 and a curved driven section 120. Flat driven section 118 is designed to be driven by flat surface 60 on crank pin 26 and curved driven section 120 is designed to be driven by a curved drive portion 122 of crank pin 26. Cam 110 rests on the bottom of the recess of bearing housing 18 defined by circular wall 66 or on the generally flat top circular portion 124 of crankshaft 24 with crank pin 26 extending through opening 116 of cam 110. Base 112 defines a circular recess 126 extending into the bottom of base 112 to mate with circular portion 124 of crankshaft 24. A plurality of generally trapezoidal recesses 128 are formed into the top and bottom of base 112 to form a plurality of ribs 130 to provide strength for base 112. A pair of tabs 132 extend from the outer surface of base 112 and are used during the assembly of cam 110 to crankshaft 24. Cam 110 is assembled to crankshaft 24 after crankshaft 24 has been assembled to main bearing housing 18. Due to crank pin 26 being offset from the center of crankshaft 24 and the location of opening 116 within base 112 of cam 110, it is possible to install cam 110 over crank pin 26 without having recess 126 engaging circular portion 124 of crankshaft 24. This mis-assembly could go undetected until additional components of the compressor have been assembled. In order to eliminate this mis-assembly possibility, tabs 132 operate to center cam 110 within the recess of bearing housing 18 defined by circular wall 66 and thus ensure the engagement between recess 126 of cam 110 and circular portion 124. Tabs 132 include an angular surface which aids in the distribution of lubricating oil within the recess defined by circular wall 66.

During forward rotation of crankshaft 24, flat drive surface 60 of crank pin 26 engages flat driven section 118 of cam 110. During reverse rotation of crankshaft 24, curved drive portion 122 of crank pin 26 engages curved driven section 120 of cam 110. The result is essentially a lost motion positive drive connection between cam 110 and crank pin 26 of crankshaft 24.

Curved wedge shaped wall 114 includes a curved outer surface 134 and a curved inner surface 136. The center of curvature of outer surface 134 is offset from the center of curvature of inner surface 136 to provide the curved wedge shape for wall 114. Curved outer surface 134 is designed to engage circular wall 66 on bearing housing 18. Curved inner surface 136 is designed to engage circular surface 52 on hub 50 of orbiting scroll member 42. A recessed area 138 extends along the entire length of wall 114 at the end of wall 114 adjacent to base 112. Recessed area 138 facilitates the flow of oil within the recess of bearing housing 18 defined by circular wall 66 through an oil drain port 140 (FIG. 1) extending through bearing housing 18 leading to the oil sump in the bottom of shell 10. A second generally triangular shaped recess 142 extends into wall 114 from outer surface 134. Recess 142 operates to throw lubricating oil from the recessed area in bearing housing 18 defined by circular wall 66 onto annular thrust bearing surface 40 and onto thrust surface 48 to lubricate the interface between these surfaces.

Cam 110 functions at compressor shut down by unloading orbiting scroll member 42 and holding it in check while allowing discharge gas to balance with suction gas. In doing so, cam 110 prevents contact between wraps 46 and 72 when discharge gas drives the compressor in reverse, thus eliminating the associated shutdown noises generated by contact between the opposing wraps.

Figure 9:
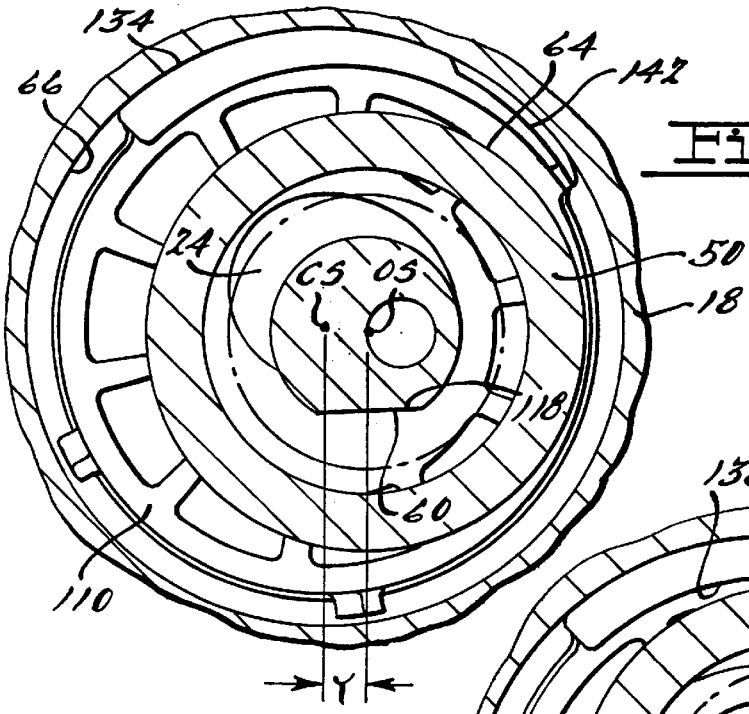
FIG. 9 is a diagrammatic illustration of how the wedge cam of the present invention functions during normal operation of the compressor.

FIG. 9 shows the components in their "normal operating" positions. In FIG. 9, the center of scroll hub 50 and circular surface 52 are indicated at os and the center of rotation of crankshaft 24 and the center of circular wall 66 is indicated at cs. The distance between these two centers is r which is the orbiting radius of orbiting scroll member 42 which will be determined by scroll flank contact due to flat driving surface 60 engaging flat driven surface 62 of drive bushing 56. During normal operation, cam 110 rotates clockwise (as shown) with crankshaft 24 and by design is driven by crankshaft 24 via driving surface 60 and driven section 118. Consequently, there is relative rotational motion between cam 110 and scroll hub 50 (which orbits) and relative motion between outer surface 134 of cam 110 and circular wall 66 (which is stationary). Outer surface 134 may contact circular wall 66 but lubricating oil located in the recess of bearing housing 18 defined by circular wall 66, the surface finish of wall 66 and the composition of the material used to manufacture cam 110 ensure a limited amount of resistance between these components during their relative rotational movement. Also, during forward rotation of cam 110, recess 142 operates to throw lubricating oil onto thrust surfaces 40 and 48 while recess 138 permits the flow of oil through drain port 140 and back to the oil sump located at the bottom of shell 10.

Figure 10:
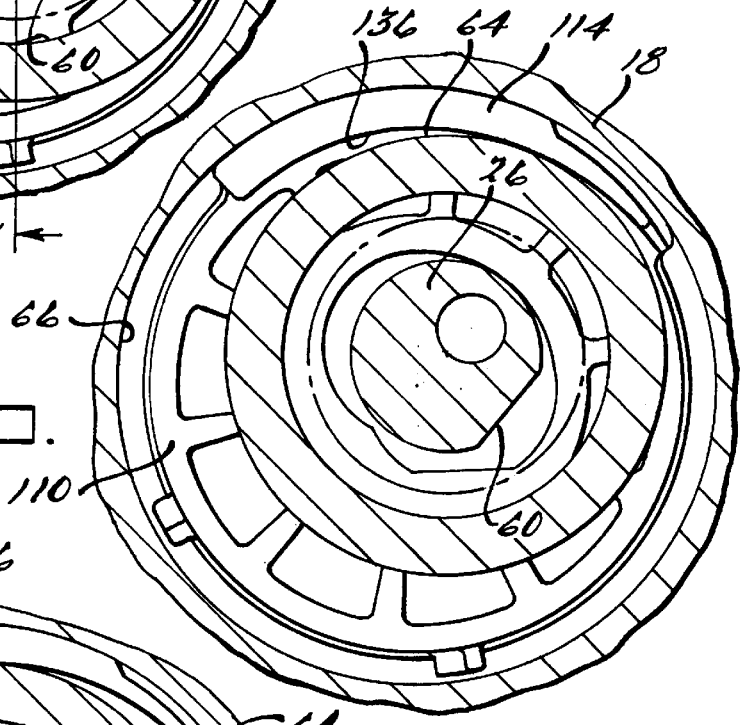
FIG. 10 is a diagrammatic illustration of how the wedge cam of the present invention functions during the initial reverse rotation of the compressor.

Referring now to FIG. 10, after the compressor has been shut down, the pressurized chambers and/or backflow of compressed gas from the discharge chamber causes a counter clockwise rotation of crank pin 26 in relation to cam 110. Cam 110 is bathed in lubricating oil located in the recess of bearing housing 18 defined by wall 66 and will initially remain stationary in relation to crank pin 26. Contact between outer surface 52 on hub 50 and inner surface 136 on cam 110 will occur somewhere between 40° and 50° of relative rotation between crank pin 26 and cam 110. Once contact has been made between outer surface 52 and inner surface 136, continued rotation between crank pin 26 and cam 110 will cause separation of scroll wraps 46 and 72 due to the shape of curved wedge shaped wall 114 and the movement of orbiting scroll member 42 along flat driving surface 60 of crank pin 26.

Figure 11:
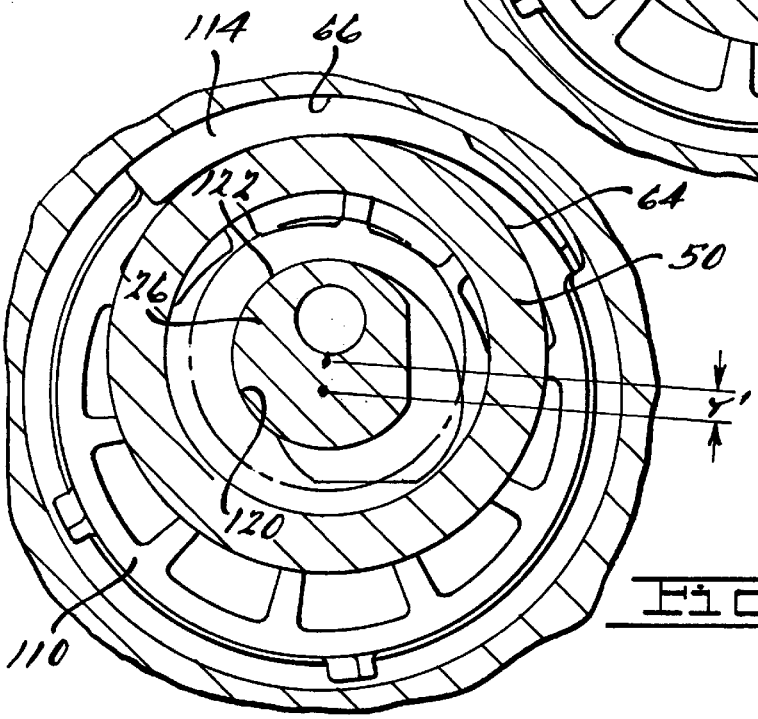
FIG. 11 is a diagrammatic illustration of how the wedge cam of the present invention functions during the remaining reverse rotation of the compressor.

Referring now to FIG. 11, the relative rotation between crank pin 26 and cam 110 has reached its maximum of approximately 104° and curved drive portion 122 of crank pin 26 engages curved driven section 120 of cam 110 wedging wall 114 between wall 66 of bearing housing 18 and surface 52 of scroll hub 50. This wedging effect reduces the distance r shown in FIG. 9 to r' shown in FIG. 11. The shape of wall 114 of cam 110 is designed such that r' is less than r which thus separates wraps 46 and 72 while allowing extended reverse (counterclockwise as shown) rotation of crankshaft 24. This extended reverse rotation continues until the discharge pressure balances with the suction pressure. During this reverse rotation, wall 114 of cam 110 maintains a gap between wraps 46 and 72 providing a path for refrigerant at discharge pressure to bleed to suction pressure while ensuring that wraps 46 and 72 do not contact each other generating the typical noise encountered at compressor shut down. The lubrication oil present, the surface finish of surface 52, the surface finish of surface 66 and the material used to manufacture cam 110 ensure the relatively free rotation of cam 110 with respect to bearing housing 18.

Another consideration in the design of cam 110 is its ability to not be damaged or cause damage in the event the compressor is powered by a miswired three-phase motor, which would cause the motor to be powered in the reverse direction. The case of powered reversal is the same as the normal reverse at shutdown shown in FIG. 11. On powered reverse cam 110 allows reverse rotation so that the compressor will run inefficiently, overheat and trip motor protector 36 without damage. A powered reverse is initiated by crankshaft 24, which in turn causes sequential motion in the other components (wedge cam, drive bushing and orbiting scroll member).

Figure 12:
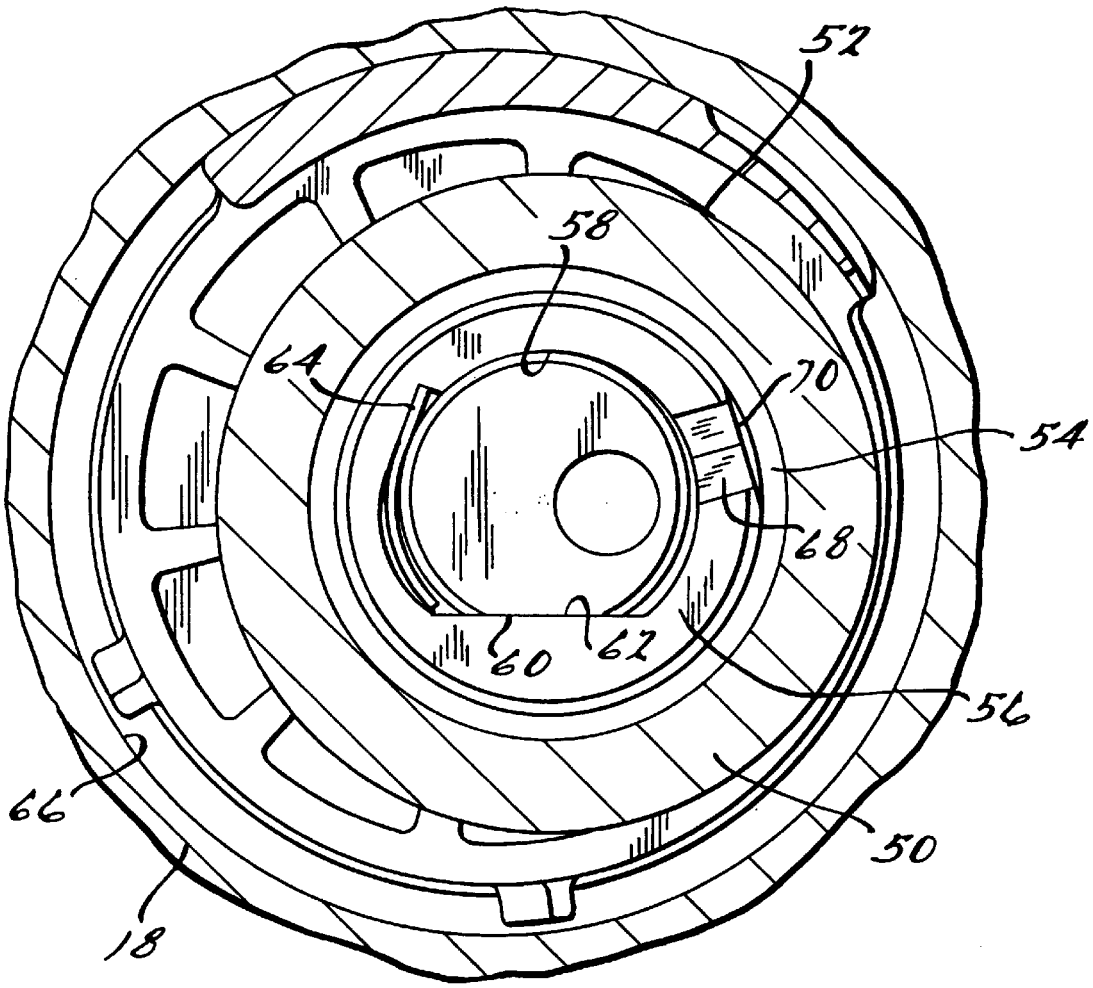
FIG. 12 is a view similar to FIG. 3 but showing an additional embodiment of the present invention.

Referring now to FIG. 12, another embodiment of the present invention is shown. The embodiment shown in FIG. 12 is the same as the embodiment described above but a spring 64 is disposed between crank pin 26 and drive bushing 56. Spring 64 biases drive bushing 56 and thus orbiting scroll member 42 in a direction away from the center of crank pin 26 and towards the center of crankshaft 24. This biasing of orbiting scroll member 42 thus tends to reduce the orbiting radius and separate the wraps of the two scroll members to reduce the loading exerted on cam 110 as well as ensuring that the wraps remain separated during start up of the compressor. This is particularly advantageous for compressors being powered by single phase motors.

Figure 13:
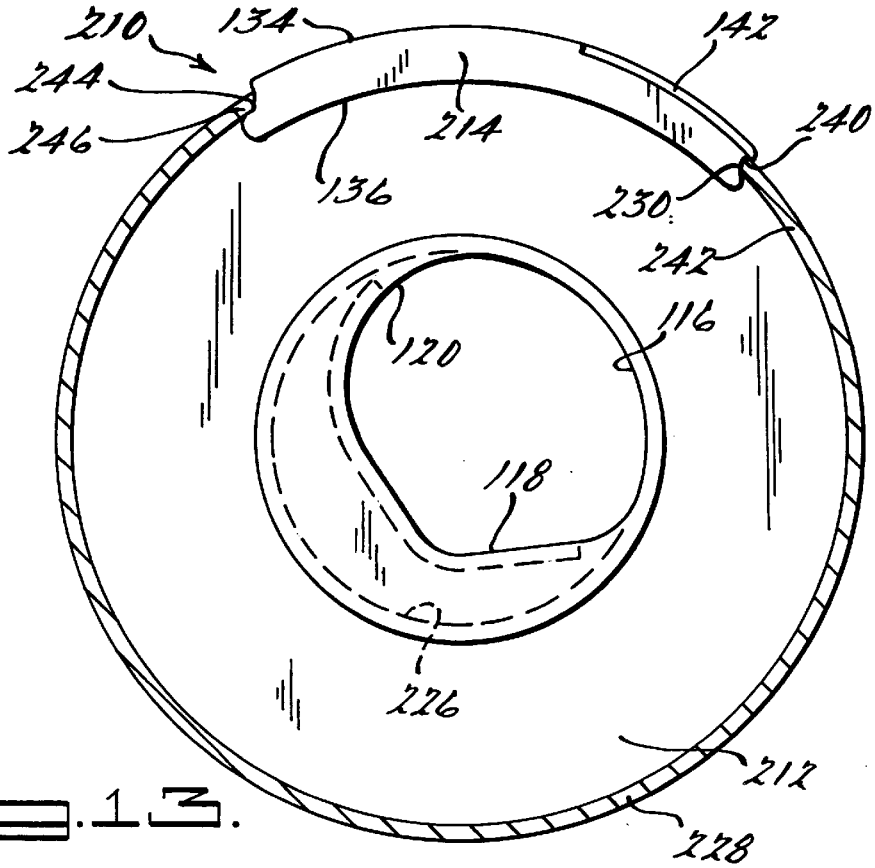
FIG. 13 is a top plan view of a wedge cam in accordance with another embodiment of the present invention.
Figure 14:
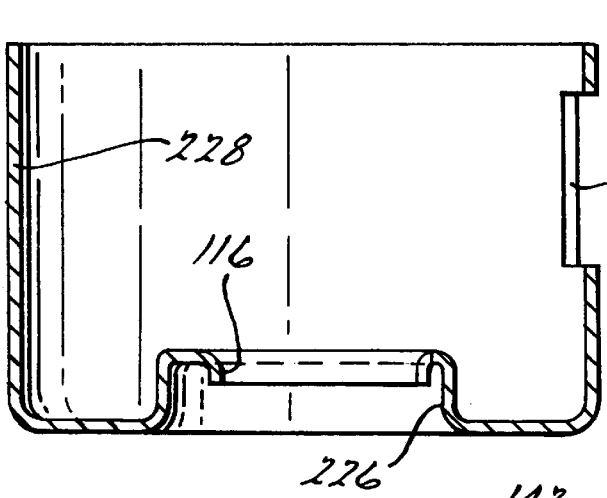
FIG. 14 is a side view partially in cross-section of the cup shaped base shown in FIG. 13.
Figure 15:
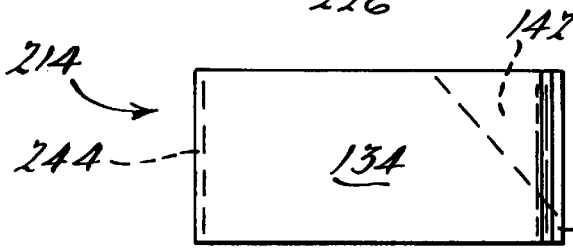
FIG. 15 is a side view of the wedge shaped insert shown in FIG. 13.

Referring now to FIGS. 13–15, a wedge cam 210 in accordance with another embodiment of the invention is disclosed. Wedge cam 210 comprises a generally cup shaped base 212 and a curved wedge shaped wall insert 214 fixedly secured to base 212.

Cup shaped base 212 is preferably manufactured from metal and it is provided with irregular shaped opening 116 which defines flat driven section 118 and curved driven section 120. Flat driven section 118 is designed to be driven by flat surface 60 on crank pin 26 and curved driven section 120 is designed to be driven by curved drive portion 122 of crank pin 26. Cam 210 rests on the bottom of the recess of bearing housing 18 defined by circular wall 66 or on the generally flat top circular portion 124 of crankshaft 24 with crank pin 26 extending through opening 116 of cam 210. Base 212 defines a circular recess 226 extending into the bottom of base 212 which mates with the outer diameter of crankshaft 24 adjacent surface 124. A generally circular wall 228 extends upward and defines an aperture 230 within which insert 214 is secured.

During forward rotation of crankshaft 24, flat drive surface 60 of crank pin 26 engages flat driven section 118 of cam 210. During reverse rotation of crankshaft 24, flat drive surface 60 of crank pin 26 engages flat driven section 118 of cam 210. During reverse rotation of crankshaft 24, curved drive portion 122 of crank pin 26 engages curved driven section 120 of cam 210. The result is essentially a lost motion positive drive connection between cam 210 and crank pin 26 of crankshaft 24.

Curved wedge shaped wall insert 214 is preferably made from plastic and is snap fit within aperture 230 and it includes curved outer surface 134 and curved inner surface 136. The center of curvature of outer surface 134 is offset from the center of curvature of inner surface 136 to provide the cured wedge shape for insert 214. Curved outer surface 134 is designed to engage circular wall 66 on bearing housing 18. Curved inner surface 136 is designed to engage circular surface 52 on hub 50 of orbiting scroll member 42. The location of aperture 230 on wall 228 defines recessed area 138 which facilitates the flow of oil within the recess of bearing housing 18 defined by circular wall 66 through oil drain port 140 (FIG. 1). Insert 214 also includes triangular shaped recess 142 which operates to throw lubricating oil from the recessed area in bearing housing 18 defined by circular wall 66 onto annular thrust bearing surface 40 and onto thrust surface 48 to lubricate the interface between these surfaces.

One end of insert 214 defines a longitudinally extending groove 240 which mates with one of the longitudinal walls 242 which define aperture 230. The opposite end of insert 214 also defines a longitudinally extending groove 244 which mates with the other of the longitudinal walls 246 which define aperture 230. Insert 214 is assembled to base 212 by first inserting groove 240 over wall 242 with insert 214 being positioned on the inside of cup shaped base 212. The opposite end of insert 214 is pushed against the inner portion of wall 228 adjacent aperture 230 until groove 244 of insert 214 snaps over wall 246 due to the elastic deformation of insert 214 and base 212.

Once cam 210 is assembled and inserted into the compressor, cam 210 functions at compressor shut down by unloading orbiting scroll member 42 and holding it in check while allowing discharge gas pressure to balance with suction gas pressure. In doing so, cam 210 prevents contact between wraps 46 and 72 when discharge gas drives the compressor in reverse, thus eliminating the associated shutdown noises generated by contact between the opposing wraps. The operation of cam 210 is the same as that detailed above for cam 110.

Figure 16:
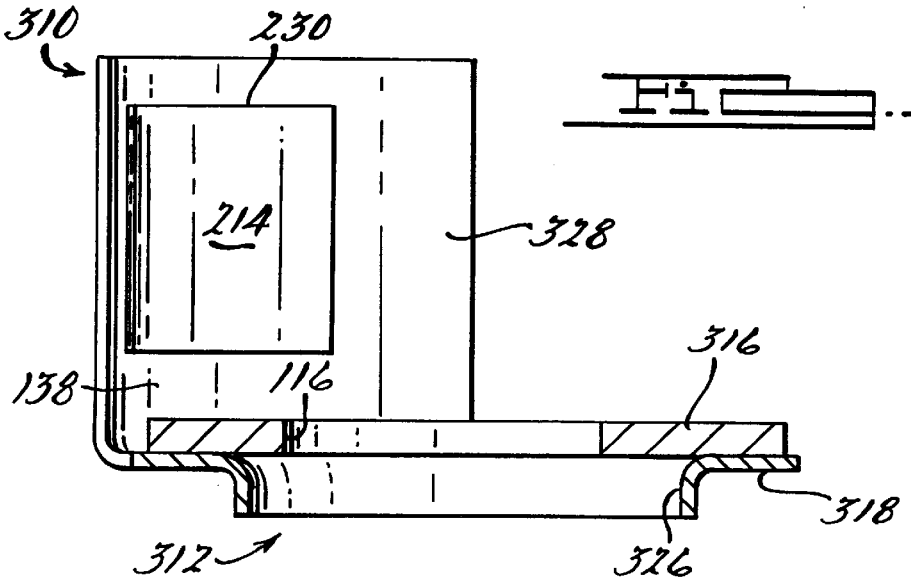
FIG. 16 is a side view, partially in cross-section of a wedge cam in accordance with another embodiment of the present invention.
Figure 17:
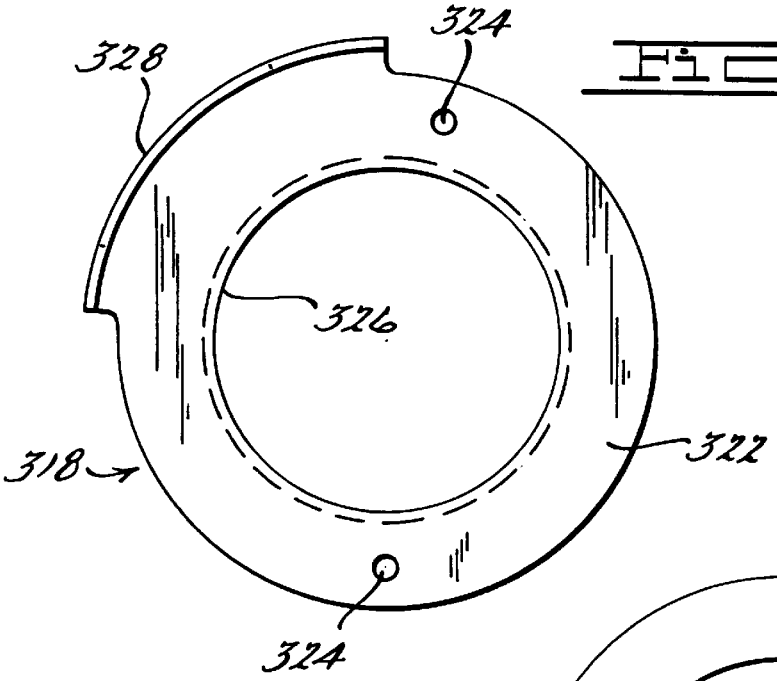
FIG. 17 is a top plan view of the support housing shown in FIG. 16.
Figure 18:
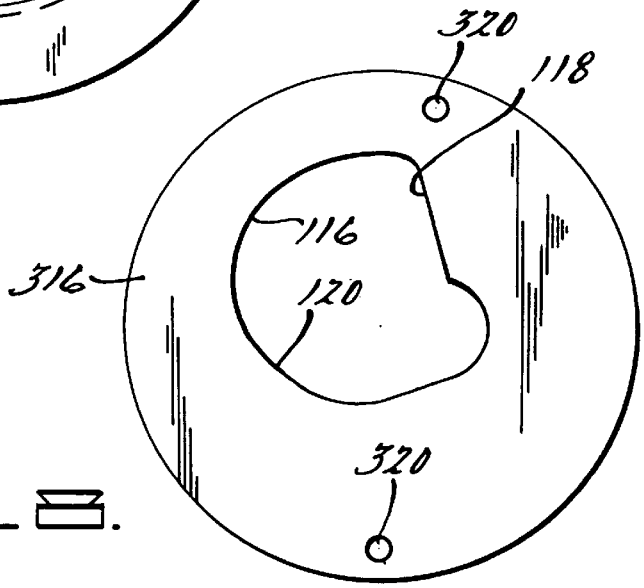
FIG. 18 is a top plan view of the drive plate shown in FIG. 16.

Referring now to FIGS. 16–18, a wedge cam 310 in accordance with and their embodiment of the present invention is disclosed. Wedge cam 310 comprises a base assembly 312 and curved wedge shaped wall insert 214 fixedly secured to base assembly 312.

Base assembly 312 is comprised of a drive plate 316 and a support housing 318. Drive plate 316 is preferably manufactured from metal and it is provided with regular shaped opening 116 which defines flat driven section 118 and curved driven section 120. Flat driven section 118 is designed to be driven by flat surface 60 on crank pin 26 and curved driven section 120 is designed to be driven by curved drive portion 122 of crank pin 26. Drive plate 316 rests on the bottom of the recess of bearing housing 18 defined by circular wall 66 or on the generally flat top circular portion 124 of crankshaft 24 with crank pin 26 extending through opening 116 in drive plate 316. Drive plate 316 includes a pair of circular protrusions 320 which mate with support housing 318 to secure the two components together.

Support housing 318 includes a generally circular base 322 having a pair of apertures 324 and a circular recess 326 and an upstanding curved wall 328 defining aperture 230. Support housing 318 is secured to drive plate 316 by having protrusions 320 mate with and extend through apertures 324. Once assembled, support housing 318 is secured to drive plate 316 by forming protrusions 320 over apertures 324 by welding, peening or other means known in the art. Circular recess 326 extends from the bottom of support housing 318 and mates with the outer diameter of crankshaft 24 adjacent surface 124. Aperture 230 in curved wall 328 accepts insert 214 to complete the assembly of wedge cam 310.

During forward rotation of crankshaft 24, flat drive surface 60 of crank pin 26 engages flat driven section 118 of cam 310. During reverse rotation of crankshaft 24, curved drive portion 122 of crank pin 26 engages curved driven section 120 of cam 310. The result is essentially a lost motion positive drive connection between cam 310 and crank pin 26 of crankshaft 24.

Curved wedge shaped wall insert 214 is snap fit within aperture 230 of support housing 318 in the manner described above for aperture 230 of wall 228. The location of aperture 230 on wall 328 defines recessed area 138 in the same manner described above for wedge cam 210. The assembly, function and operation of insert 214 in wedge cam 310 is the same as described above for wedge cam 210.

Figure 19:
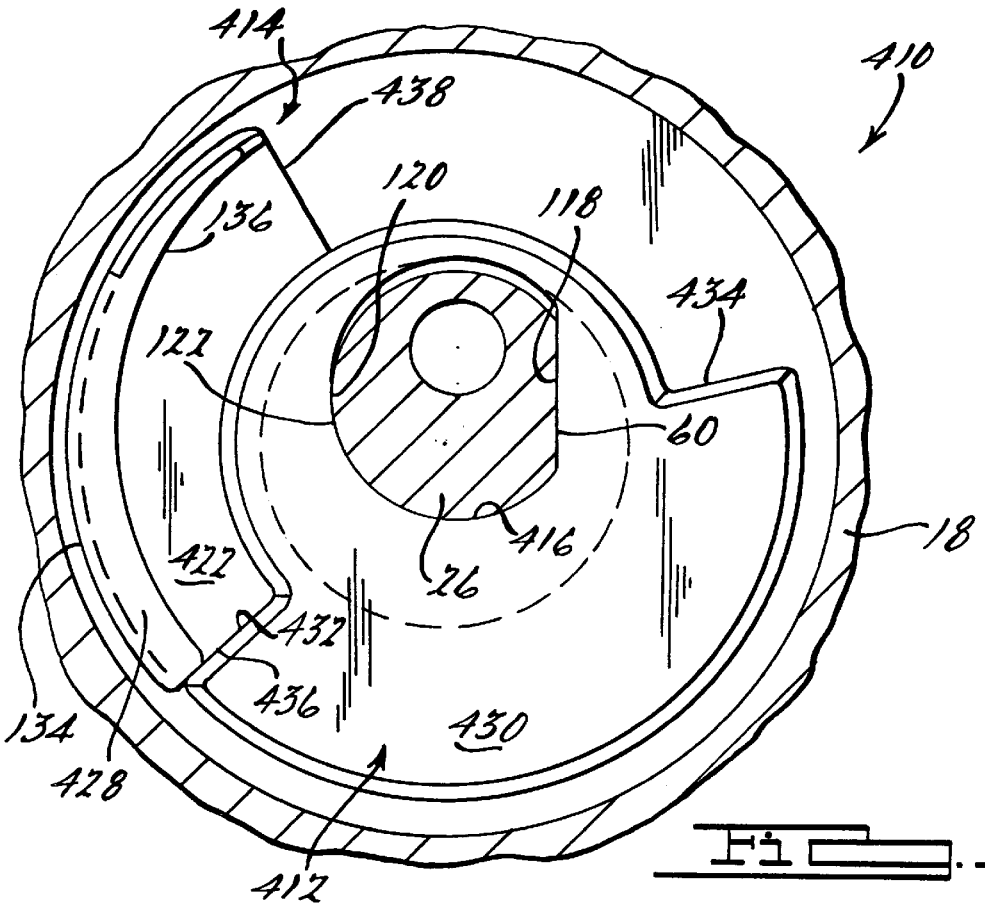
FIG. 19 is a top plan view of a wedge cam assembled to a compressor in accordance with another embodiment of the present invention.
Figure 20:
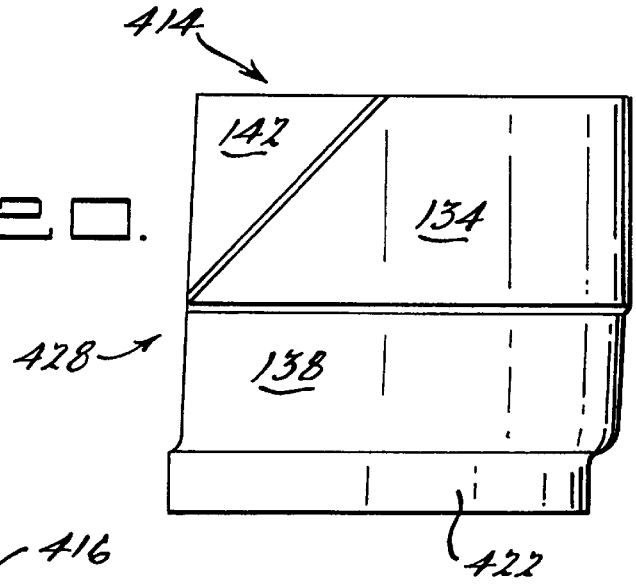
FIG. 20 is a side view of the wedge shaped member shown in FIG. 19.
Figure 21:
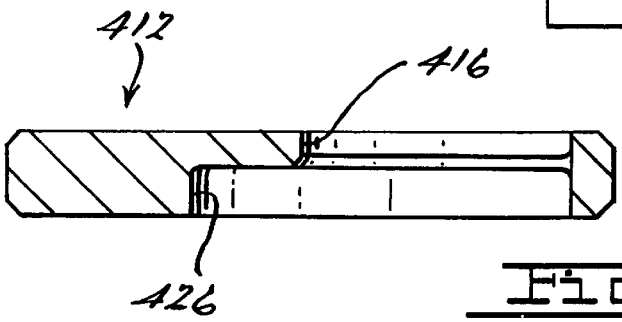
FIG. 21 is a side view in cross-section of the driving base shown in FIG. 19.

Referring now to FIGS. 19–21, a wedge cam 410 in accordance with another embodiment of the present invention is disclosed. Wedge cam 410 comprises a driving base 412 and a driven curved wedge shaped member 414.

Driving base 412 is preferably manufactured from metal and it is provided with opening 416 which is designed to be slidingly received over crank pin 26 of crankshaft 24. Opening 416 defines flat driven section 118 and curved driven section 120. Flat driven section 118 is designed to be driven by flat surface 60 on crank pin 26 and curved driven section 120 is designed to be driven by curved drive portion 122 of crank pin 26. Thus, driving base 412 rotates directly with crankshaft 24 during both the forward and reverse rotation of crankshaft 24. Driving base 412 rests on the bottom of the recess of bearing housing 18 defined by circular wall 66 or on the generally flat top circular portion of crankshaft 24 with crank pin 26 extending through opening 416 of base 412. Base 412 defines a circular recess 426 extending into the bottom of base 412 which mates with the outer diameter of crankshaft 24 adjacent surface 124. Driving base 412 includes a partially circular section 430 which has a pair of driving surfaces 432 and 434 which drive wedge shaped member 414 during forward and reverse rotation of crankshaft 24.

Wedge shaped member 414 is preferably made of plastic and it includes an arc shaped base 422 and an upstanding curved wall 428. Wedge shaped member 414 rests on the bottom of the recess of bearing housing 18 defined by circular wall 66. Arc shaped base 422 includes a pair of driven surfaces 436 and 438 which respectively mate with driving surfaces 432 and 434 of driving base 412. The angular distance between surfaces 432 and 434 combined with the angular distance between surfaces 436 and 438 is less than a full circle of 360° as shown in FIG. 19 to provide a lost motion positive drive between driving base 412 and wedge shaped member 414. During forward rotation of crankshaft 24, driving surface 432 of driving base 412 engages driven surface 436 of member 414. During reverse rotation of crankshaft 24, driving surface 434 of driving base 412 engages driven surface 438 of member 414. Due to the open space between driving base 412 and member 414, the lost motion positive drive connection is provided.

Upstanding curved wall 428 of member 414 includes curved outer surface 134 and curved inner surface 136 to provide the curved wedge shape for member 414. Curved outer surface 134 is designed to engage circular wall 66 on bearing housing 18. Curved inner surface 136 is designed to engage circular surface 52 on hub 50 of orbiting scroll member 42. Recessed area 138 extends along the entire length of wall 428 adjacent to base 422. Recessed area 138 facilitates the flow of oil within the recess of bearing housing 18 defined by circular wall 66 through oil drain port 140 (FIG. 1). Triangular shaped recess 142 extends into wall 428 from outer surface 134. Recess 142 operates to throw lubricating oil from the recessed area in bearing housing 18 defined by circular wall 66 onto annular thrust bearing surface 40 and onto thrust surface 48 to lubricate the interface between these surfaces.

The function and operation of wedge cam 410 is the same as described above for wedge cam 110, 210 and 310.

While the above detailed description describes the preferred embodiment of the present invention, it should be understood that the present invention is susceptible to modification, variation and alteration without deviating from the scope and fair meaning of the subjoined claims.

What is claimed is:

1. A scroll compressor comprising:

a first scroll member having a spiral wrap thereon;

a second scroll member having a spiral wrap thereon;

a housing for mounting said scroll members so that said second scroll member orbits with regard to said first scroll member with the respective spiral wraps of each scroll member engaging one another in such a way that pockets of progressively changing volume are created between said scroll members in response to said orbital movement in a forward direction;

a powered rotatable shaft normally rotating in a forward direction to cause said orbital movement in said forward direction;

a base journaled on said shaft, said base defining an aperture; and a wedge shaped insert disposed in said aperture for separating said spiral wraps during extended operation of said compressor in a reverse direction, said base and said insert being responsive to an initial reverse rotation of said shaft.

2. A scroll compressor as claimed in claim 1 wherein said base includes a circular wall, said aperture being disposed within said circular wall.

3. A scroll compressor as claimed in claim 2 wherein said base and said insert are directly responsive to reverse movement of said second scroll member.

4. A scroll compressor as claimed in claim 2 wherein said insert contacts a surface on said housing, said surface being generally circular and concentric with the rotational axis of said shaft.

5. A scroll compressor as claimed in claim 2 wherein said base is driven in the forward direction by and rotates with said shaft during normal operation of said compressor.

6. A scroll compressor as claimed in claim 2 wherein said base and said insert are inoperative to prevent powered reverse rotation of said shaft.

7. A scroll compressor as claimed in claim 2 wherein there is a lost motion driving connection between said shaft and said base.

8. A scroll compressor as claimed in claim 1 wherein said base includes a drive plate secured to a support housing, said aperture being disposed within said support housing.

9. A scroll compressor as claimed in claim 8 wherein said base and said insert are directly responsive to reverse movement of said second scroll member.

10. A scroll compressor as claimed in claim 8 wherein said insert contacts a surface on said housing, said surface being generally circular and concentric with the rotational axis of said shaft.

11. A scroll compressor as claimed in claim 8 wherein said drive plate is driven in the forward direction by and rotates with said shaft during normal operation of said compressor.

12. A scroll compressor as claimed in claim 8 wherein said base and said insert are inoperative to prevent powered reverse rotation of said shaft.

13. A scroll compressor as claimed in claim 8 wherein there is a lost motion driving connection between said shaft and said drive plate.

14. A scroll compressor as claimed in claim 1 wherein said base and said insert are directly responsive to reverse movement of said second scroll member.

15. A scroll compressor as claimed in claim 1 wherein said insert contacts a surface on said housing, said surface being generally circular and concentric with the rotational axis of said shaft.

16. A scroll compressor as claimed in claim 1 wherein said base is driven in the forward direction by and rotates with said shaft during normal operation of said compressor.

17. A scroll compressor as claimed in claim 1 wherein said base and said insert are inoperative to prevent powered reverse rotation of said shaft.

18. A scroll compressor as claimed in claim 1 wherein there is a lost motion driving connection between said shaft and said base.

19. A scroll compressor comprising:

a first scroll member having a spiral wrap thereon;

a second scroll member having a spiral wrap thereon;

a housing for mounting said scroll members so that said second scroll member orbits with regard to said first scroll member with the respective spiral wraps of each scroll member engaging one another in such a way that pockets of progressively changing volume are created between said scroll members in response to said orbital movement in a forward direction;

a powered rotatable shaft normally rotating in a forward direction to cause said orbital movement in said forward direction;

a driving base journaled on said shaft; and a driven wedge shaped member independent from said driving base for separating said spiral wraps during extended operation of said compressor in a reverse direction, said base and said wedge shaped member being responsive to an initial reverse rotation of said shaft.

20. A scroll compressor as claimed in claim 19 wherein said base and said wedge shaped member are directly responsive to reverse movement of said second scroll member.

21. A scroll compressor as claimed in claim 19 wherein said wedge shaped member contacts a surface on said housing, said surface being generally circular and concentric with the rotational axis of said shaft.

22. A scroll compressor as claimed in claim 19 wherein said base is driven in the forward direction by and rotates with said shaft during normal operation of said compressor.

23. A scroll compressor as claimed in claim 19 wherein said base and said wedge shaped member are inoperative to prevent powered reverse rotation of said shaft.

24. A scroll compressor as claimed in claim 19 wherein there is a lost motion driving connection between said base and said wedge shaped member.

* * * * *